US006624566B2

(12) United States Patent
Uemura et al.

(10) Patent No.: US 6,624,566 B2
(45) Date of Patent: Sep. 23, 2003

(54) VACUUM FLUORESCENT DISPLAY

(75) Inventors: Sashiro Uemura, Mie (JP); Junko Yotani, Mie (JP); Takeshi Nagasako, Mie (JP); Hiromu Yamada, Mie (JP); Hiroyuki Kurachi, Mie (JP)

(73) Assignees: Ise Electronics Corporation, Ise (JP); Noritake Co., Ltd., Nagoya (JP)

( * ) Notice: Subject to any disclaimer, the term of this patent is extended or adjusted under 35 U.S.C. 154(b) by 103 days.

(21) Appl. No.: 09/941,392

(22) Filed: Aug. 28, 2001

(65) Prior Publication Data

US 2002/0024296 A1 Feb. 28, 2002

(30) Foreign Application Priority Data

Aug. 29, 2000 (JP) ..... 2000/258622

(51) Int. Cl.[7] ..... H01J 1/62; H01J 63/04; H01J 1/05; H01J 1/02; H01J 29/70

(52) U.S. Cl. ..... 313/496; 313/495; 313/497; 313/309; 313/310; 313/311; 313/422

(58) Field of Search ..... 313/495, 496, 313/497, 309, 310, 311, 422

(56) References Cited

U.S. PATENT DOCUMENTS 5,214,347 A * 5/1993 Gray ..... 313/355
6,135,839 A * 10/2000 Iwase et al. ..... 445/24
6,239,547 B1 5/2001 Uemura et al.
6,455,989 B1 * 9/2002 Nakada et al. ..... 313/309
6,465,132 B1 * 10/2002 Jin ..... 429/231.8
6,489,710 B1 * 12/2002 Okita et al. ..... 313/309

* cited by examiner

*Primary Examiner*—Vip Patel
*Assistant Examiner*—Matt Hodges
(74) *Attorney, Agent, or Firm*—Blakely, Sokoloff, Taylor & Zafman

(57) ABSTRACT

A vacuum fluorescent display includes a front glass member, substrate, control electrode, plate-like field emission type electron-emitting source, mesh-like electron extracting electrode, and phosphor film. The front glass member has light transmission properties at least partly, and the substrate opposes the front glass member through a vacuum space. The control electrode is formed on an inner surface of the substrate. The plate-like field emission type electron-emitting source with a plurality of through holes is arranged in the vacuum space to be spaced apart from the control electrode. The mesh-like electron extracting electrode is formed between the field emission type electron-emitting source and the front glass member to be spaced apart from the field emission type electron-emitting source. The phosphor film is formed inside the front glass member.

8 Claims, 4 Drawing Sheets

VACUUM FLUORESCENT DISPLAY

BACKGROUND OF THE INVENTION

The present invention relates to a vacuum fluorescent display which emits light by bombarding electrons emitted from a field emission type electron-emitting source against a phosphor.

Conventionally, as a display component for an audio apparatus or automobile dashboard, a vacuum fluorescent display is one type of electronic display device frequently used. In the vacuum fluorescent display, an anode attached with a phosphor and a cathode are arranged in a vacuum vessel to oppose each other, and electrons emitted from the cathode are bombarded against the phosphor to emit light. As a general vacuum fluorescent display, a triode structure is used most often, in which a grid for controlling the electron flow is provided between the cathode and anode, so the phosphor selectively emits light.

Recently, to greatly increase the luminance of the vacuum fluorescent display, a vacuum fluorescent display in which a field emission type electron-emitting source using carbon nanotubes is used as a cathode is proposed. FIG. 7 shows a conventional vacuum fluorescent display. Referring to FIG. 7, the conventional vacuum fluorescent display has an envelope 300 constituted by a front glass member 301 which has light transmission properties at least partly, a substrate 302 opposing the front glass member 301, and a frame-like spacer 303 for hermetically connecting the edges of the front glass member 301 and substrate 302. The interior of the envelope 300 is vacuum-evacuated.

In the envelope 300, a plurality of front surface support members 304 vertically stand on the inner surface of the front glass member 301 to be parallel to each other at a predetermined interval. Each light-emitting portion 310 constituting a display pixel is formed on a corresponding region on the inner surface of the front glass member 301 which is sandwiched by the front surface support members 304. The light-emitting portion 310 is constituted by a band-like phosphor film 311 formed on the inner surface of the front glass member 301 and a metal back film 312 formed on the surface of the phosphor film 311 and used as an anode.

A plurality of substrate support members 305 vertically stand on the substrate 302 to oppose the front surface support members 304. A plurality of band-like wiring electrodes 320 are formed in regions on the inner surface of the substrate 302 each of which is sandwiched by the substrate support members 305 to oppose the respective light-emitting portions 310. Field emission type electron-emitting sources 330 made of carbon nanotubes are formed on the wiring electrodes 320, respectively. Further, a plurality of mesh-like electron extracting electrodes 340 are arranged to be spaced apart from the field emission type electron-emitting sources 330 by a predetermined distance. The electron extracting electrodes 340 are formed in the direction perpendicular to the field emission type electron-emitting sources 330 to have a band-like shape, and arranged to be parallel to each other at a predetermined interval. The electron extracting electrodes 340 are sandwiched and fixed between the substrate support members 305 and front surface support members 304.

The operation of the vacuum fluorescent display will be described next with reference to FIG. 8. Note that the support members 304, and the support members 305, arranged between the electrodes are not shown in FIG. 8. Referring to FIG. 8, the field emission type electron-emitting sources 330 are arranged to be parallel to each other at a predetermined interval, and the electron extracting electrodes 340 are arranged above the field emission type electron-emitting sources 330. The electron extracting electrodes 340 are formed in the direction perpendicular to the field emission type electron-emitting sources 330 and arranged to be parallel to each other at a predetermined interval. The plurality of light-emitting portions 310 are arranged above the electron extracting electrodes 340 at positions opposing the respective field emission type electron-emitting sources 330.

A positive voltage (accelerating voltage) is applied to the metal back films 312 of the light-emitting portions 310. In this state, in the vacuum fluorescent display, voltages applied to each field emission type electron-emitting source 330 and each electron extracting electrode 340 switch the ON/OFF states of a corresponding one of the light-emitting portions 310 which opposes the intersecting region of the field emission type electron-emitting source 330 and electron extracting electrode 340. In this vacuum fluorescent display, when 0 V is applied to the electron extracting electrode 340, an electric field required for emitting electrons is not generated in the field emission type electron-emitting sources 330. Accordingly, the light-emitting portion 310 becomes an OFF state 310*a* independently of a voltage applied to the field emission type electron-emitting source 330.

When a predetermined positive voltage is applied to the electron extracting electrode 340, a voltage applied to each field emission type electron-emitting source 330 through a corresponding one of the wiring electrodes 320 can switch the ON/OFF states of a corresponding one of the light-emitting portions 310 which opposes the intersecting region of the field emission type electron-emitting source 330 and electron extracting electrode 340. In this case, when a voltage applied to the field emission type electron-emitting source 330 is 0 V, the light-emitting portion 310 becomes an ON state 310*b*, and when a predetermined positive voltage is applied to the field emission type electron-emitting source 330, the light-emitting portion 310 becomes the OFF state 310*a*. Accordingly, in this vacuum fluorescent display, scanning is performed such that the positive voltage is sequentially applied to the respective electron extracting electrodes 340, and in synchronism with this scanning, voltages applied to the respective field emission type electron-emitting sources 330 are switched in correspondence with the respective pixels to be displayed, thereby performing matrix display.

In the conventional vacuum fluorescent display, however, the electron-emitting sources are formed on the substrate. Therefore, when faults such as a luminance nonuniformity and the like have been found in the electron-emitting source, the substrate itself must be discarded, thereby causing a decrease in manufacturing yield.

SUMMARY OF THE INVENTION

It is an object of the present invention to provide a vacuum fluorescent display using a field emission type electron-emitting source which increases the manufacturing yield.

In order to achieve the above object, according to the present invention, there is provided a vacuum fluorescent display comprising a front glass member which has light transmission properties at least partly, a substrate opposing the front glass member through a vacuum space, a control electrode formed on an inner surface of the substrate, a plate-like field emission type electron-emitting source with a plurality of through holes which is arranged in the vacuum space to be spaced apart from the control electrode, a mesh-like electron extracting electrode formed between the field emission type electron-emitting source and the front glass member to be spaced apart from the field emission type electron-emitting source, and a phosphor film formed inside the front glass member.

DESCRIPTION OF THE PREFERRED EMBODIMENTS

The present invention will be described in detail below with reference to the accompanying drawings.

Figure 1:
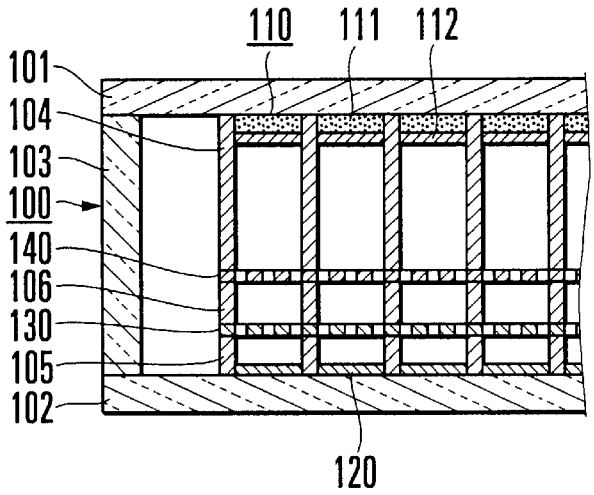
FIG. 1 is a sectional view showing the main part of a vacuum fluorescent display according to the first embodiment of the present invention.

FIG. 1 shows a vacuum fluorescent display according to the first embodiment of the present invention. Referring to FIG. 1, the vacuum fluorescent display of this embodiment has an envelope 100 constituted by a front glass member 101 which has light transmission properties at least partly, a substrate 102 opposing the front glass member 101, and a frame-like spacer 103 for hermetically connecting the edges of the front glass member 101 and substrate 102. The interior of the envelope 100 is vacuum-evacuated.

In the envelope 100, a plurality of front surface support members 104 vertically stand on the inner surface of the front glass member 101 to be parallel to each other at a predetermined interval. Each light-emitting portion 110 constituting a display pixel is formed on a corresponding region on the inner surface of the front glass member 101 which is sandwiched by the front surface support members 104. The light-emitting portion 110 is constituted by a band-like phosphor film 111 formed on the inner surface of the front glass member 101 and a metal back film 112 formed on the surface of the phosphor film 111 and used as an anode.

A plurality of substrate support members 105 vertically stand on the substrate 102 to oppose the front surface support members 104, and a plurality of band-like control electrodes 120 are formed in regions sandwiched by the substrate support members 105 to oppose the respective light-emitting portions 110. A plate-like field emission type electron-emitting source 130 with a large number of through holes is arranged to be spaced apart from the control electrodes 120 by a predetermined distance in the direction toward the front glass member 101. The field emission type electron-emitting source 130 is supported by the substrate support members 105 and arranged to correspond to all the control electrodes 120.

A plurality of mesh-like electron extracting electrodes 140 are arranged to be spaced apart from the field emission type electron-emitting source 130 by a predetermined distance in the direction to the front glass member 101. The band-like electron extracting electrodes 140 are formed in the direction perpendicular to the control electrodes 120 and arranged to be parallel to each other at a predetermined interval. The electron extracting electrodes 140 are sandwiched and fixed between the front surface support members 104 and an intermediate support member 106 which is formed through the field emission type electron-emitting source 130 so as to correspond to the substrate support members 105.

The front glass member 101, substrate 102, and spacer 103 constituting the envelope 100 are made of soda-lime glass. As the front glass member 101 and substrate 102, flat glass with a thickness of 1 mm to 2 mm is used. The front surface support member 104 is made of an insulator formed by screen-printing an insulating paste containing low-melting frit glass repeatedly to a predetermined height at a predetermined position on the inner surface of the front glass member 101, and calcining the printed insulating paste. In this embodiment, the front surface support member 104 has a width of 50 $\mu$m, and a height of 2 mm to 4 mm, and each light-emitting portion 110 arranged on a region sandwiched by the front surface support members 104 has a width of 0.3 mm.

The phosphor film 111 is made of a phosphor with a predetermined light emission color and is formed by screen-printing a phosphor paste in a stripe on the inner surface of the front glass member 101, and calcining the printed stripe to have a thickness of 10 $\mu$m to 100 $\mu$m and a width of 0.3 mm. In this case, as the phosphor film 111, three types of phosphor films may be used for emitting three primary colors of red (R), green (G), and blue (B) in color display, and a single type of phosphor film may be used for emitting a white color in monochrome display. As the phosphor film 111, known oxide phosphors or sulfide phosphors which are generally used in a cathode-ray tube or the like and emit light upon being bombarded with electrons accelerated by a high voltage of 4 kV to 10 kV can be used. The metal back film 112 is formed of an aluminum thin film with a thickness of about 0.1 $\mu$m, and is formed on the surface of the phosphor film 111 by using a known vapor deposition method.

The substrate support members 105 are made of an insulator formed by screen-printing an insulating paste containing low-melting frit glass repeatedly to a predetermined height so as to sandwich the control electrodes 120 on the substrate 102, and calcining the printed insulating paste. The substrate support member 105 has, e.g., a width of 50 $\mu$m, a height of 0.3 mm to 0.6 mm. The control electrode 120 sandwiched by the substrate support members 105 has a width of 0.3 mm.

The control electrode 120 is formed on the substrate 102 in a predetermined pattern by screen-printing a conductive paste containing silver or carbon as a conductive material, and calcining the printed conductive paste to have a thickness of about 10 μm. A method of forming the control electrode 120 is not limited to screen printing, and the control electrode 120 may be formed from, e.g., an aluminum thin film with a thickness of about 1 μm formed by using known sputtering and etching.

Figure 2:
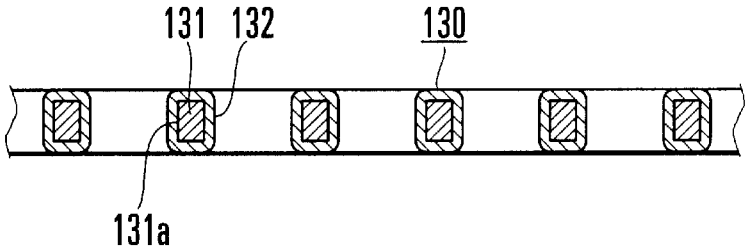
FIG. 2 is an enlarged sectional view showing a field emission type electron-emitting source shown in FIG. 1.

As shown in FIG. 2, the field emission type electron-emitting source 130 is comprised of a plate-like metal member 131 with a large number of through holes 131*a* and serving as a growth nucleus for nanotube fibers, and a coating film 132 made of a large number of nanotube fibers that cover the surface of the plate-like metal member 131 and the inner walls of the through holes 131*a*. The plate-like metal member 131 is a metal plate made of iron or an iron-containing alloy. The through holes 131*a* are formed in a matrix in the plate-like metal member 131 so the plate-like metal member 131 has a grid-like shape.

Note that the openings of the through holes 131*a* may be of any shape as far as the coating film 132 is uniformly distributed on the plate-like metal member 131, and the sizes of the openings need not be the same. For example, the openings may be polygons such as triangles, quadrangles, or hexagons, those formed by rounding the corners of such polygons, or circles or ellipses. The sectional shape of the plate-like metal member 131 between the through holes 131*a* is not limited to a square, but may be any shape such as a circle or ellipse constituted by curves, a polygon such as a triangle, quadrangle, or hexagon, or those formed by rounding the corners of such polygons.

The plate-like metal member 131 is fabricated in the following manner. First, a photosensitive resist film is formed on a flat metal plate made of iron or an iron-containing alloy. Then, a mask with a pattern of a large number of through holes is placed on the resist film, exposed with light or ultraviolet rays, and developed, thereby forming a resist film with a desired pattern. Subsequently, the metal plate is dipped in an etching solution to remove an unnecessary portion of it. After that, the resist film is removed and the resultant structure is washed, thus obtaining the plate-like metal substrate 131 having the through holes 131*a*.

In this case, the opening portions of through holes 131*a* may be formed into an arbitrary shape by the mask pattern. If a pattern is formed on the resist film on one surface of the metal plate while leaving the resist film on the other surface intact, the sectional shape of the metal portion between the adjacent through holes 131*a* and constituting the grid becomes trapezoidal or triangular. If patterns are formed on the resist films on the two surfaces, the sectional shape becomes hexagonal or rhombic. The sectional shape can be changed in this manner in accordance with the manufacturing methods and manufacturing conditions. After etching, if electropolishing is performed, a curved sectional shape can be obtained.

Iron or an iron-containing alloy is used as the plate-like metal member 131 because iron serves as a growth nucleus for carbon nanotube fibers. When iron is selected to form the plate-like metal member 131, industrial pure iron (Fe with a purity of 99.96%) is used. This purity is not specifically defined, and can be, e.g., 97% or 99.9%. As the iron-containing alloy, for example, a 42 alloy (42% of Ni) or a 42-6 alloy (42% of Ni and 6% of Cr) can be used. However, the present invention is not limited to them. In this embodiment, a 42-6 alloy thin plate with a thickness of 0.05 mm to 0.20 mm was used considering the manufacturing cost and availability.

The nanotube fibers of the coating film 132 have thicknesses of about 10 nm or more and less than 1 μm, and lengths of about 1 μm or more and less than 100 μm, and are made of carbon. The nanotube fibers may be single-layered carbon nanotubes in each of which a graphite single layer is cylindrically closed and a 5-membered ring is formed at the tip of the cylinder. Alternatively, the nanotube fibers may be coaxial multilayered carbon nanotubes in each of which a plurality of graphite layers are multilayered to form a telescopic structure and are respectively cylindrically closed, hollow graphite tubes each with a disordered structure to produce a defect, or graphite tubes filled with carbon. Alternatively, the nanotubes may mixedly have these structures.

Such a nanotube fiber has one end connected to the surface of the plate-like metal member 131 or the inner wall of a through hole 131*a* and is curled or entangled with other nanotube fibers to cover the surface of the metal portion constituting the grid, thereby forming the cotton-like coating film 222. In this case, the coating film 132 covers the plate-like metal member 131 made of a 42-6 alloy with the thickness of 0.05 mm to 0.20 mm by a thickness of 10 μm to 30 μm to form a smooth curved surface.

The coating film 132 can be formed by using the following thermal CVD (Chemical Vapor Deposition). First, the plate-like metal member 131 is set in the reaction chamber, and the interior of the reaction chamber is evacuated to vacuum. Then, methane gas and hydrogen gas, or carbon monoxide gas and hydrogen gas are introduced into the reaction chamber at a predetermined ratio, and the interior of the reaction chamber is held at 1 atm. In this atmosphere, the plate-like metal member 131 is heated for a predetermined period of time by an infrared lamp, so that the carbon nanotube fiber is grown on the surface of the plate-like metal member 131 and the inner walls of the through holes 131*a* constituting the grid, thus forming the coating film 132. With thermal CVD, carbon nanotube fibers constituting the coating film 132 can be formed in a curled state.

Since the field emission type electron-emitting source 130 need not be printed on the substrate 102, operation check can be performed to only the field emission type electron-emitting source 130 to check whether nonuniform electron emission which causes luminance nonuniformity is present. Therefore, the field emission type electron-emitting source 130 is incorporated in the vacuum fluorescent display after the end of the operation check.

The electron extracting electrode 140 is formed of a 50 μm thick stainless steel plate or 42-6 alloy and has a mesh structure in which a large number of electron passing holes are formed by etching. Each electron passing hole has a diameter of 20 μm to 100 μm. The intermediate support member 106 is formed of an insulating substrate with a plurality of slits corresponding to the respective light-emitting portions 110, and stacked on the field emission type electron-emitting source 130. The slit has the same length and width as those of the light-emitting portion 110. A 0.3 mm thick alumina substrate is used as the insulating substrate, and the slits are formed by using laser beam.

The intermediate support member 106 is not limited to the alumina substrate, and the insulating substrate such as a glass substrate may be used. A distance between the field emission type electron-emitting source 130 and electron extracting electrodes 140 is set by the thickness of the intermediate support member 106. In this case, the thickness of the intermediate support member 106 must be set considering the height of the substrate support member 105 which serves as a distance between the field emission type electron-emitting source 130 and control electrode 120 because the strength of the electric field applied to the field emission type electron-emitting source 130 is affected.

Figure 3:
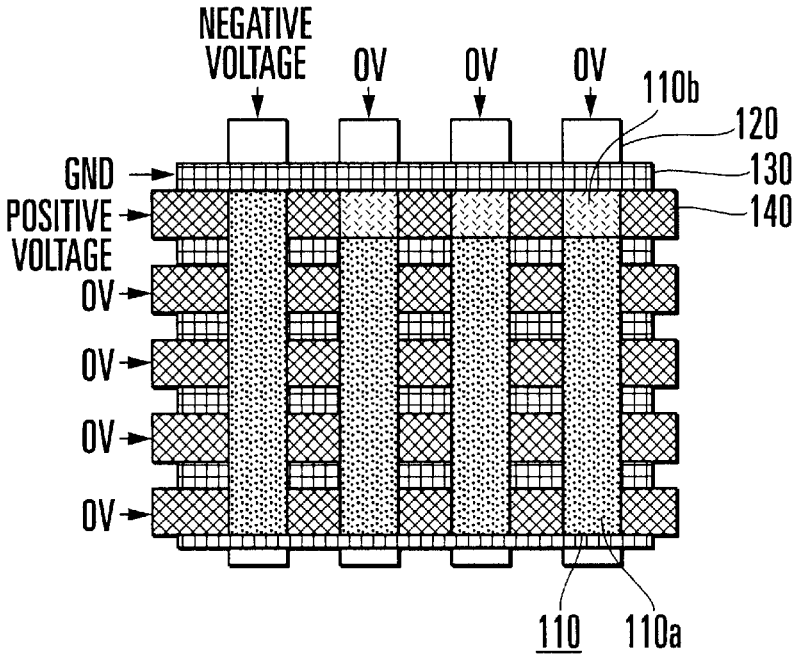
FIG. 3 is a view for explaining the relationship between voltages applied to electrodes and light emission states of light-emitting portions of the vacuum fluorescent display shown in FIG. 1.

The operation of the vacuum fluorescent display with the above arrangement will be described with reference to FIG. 3. The support members 104, 105, and 106 arranged between the electrodes are not shown in FIG. 3. Referring to FIG. 3, the single field emission type electron-emitting source 130 is arranged above the control electrodes 120 which are arranged to be parallel to each other at a predetermined interval. The plurality of electron extracting electrodes 140 are arranged above the field emission type electron-emitting source 130 to be parallel to each other at a predetermined interval, which are formed in the direction perpendicular to the control electrodes 120. The plurality of light-emitting portions 110 are arranged above the electron extracting electrodes 140 at positions opposing the respective control electrodes 120.

The field emission type electron-emitting source 130 is connected to ground (GND), and a positive voltage (accelerating voltage) is applied to the metal back films 112 of the light-emitting portions 110. In this state, voltages applied to each control electrode 120 and each electron extracting electrode 140 switch the ON/OFF states of a corresponding one of the light-emitting portions 110 which opposes the intersecting region of these electrodes. When 0 V is applied to the electron extracting electrode 140, an electric field required for emitting electrons is not generated in the field emission type electron-emitting source 130. Accordingly, the light-emitting portion 110 becomes an OFF state 110*a* independently of a voltage applied to the control electrode 120.

When a predetermined positive voltage is applied to the electron extracting electrode 140, a voltage applied to each control electrode 120 can switch the ON/OFF states of a corresponding one of the light-emitting portions 110 which opposes the intersecting region of the control electrode 120 and electron extracting electrode 140. In this case, when a voltage applied to the control electrode 120 is 0 V, the light-emitting portion 110 becomes an ON state 110*b*, and when a predetermined negative voltage is applied to the control electrode 120, the light-emitting portion 110 becomes the OFF state 110*a*. A reason why a voltage applied to each control electrode 120 switches the ON/OFF states of a corresponding one of the light-emitting portions 110, as described above, will be described next.

When a high electric field is applied to a solid surface, a potential barrier on the surface which confines electrons in a solid becomes low and thin. Thus, electrons confined in the solid are emitted outside by the tunneling effect. This phenomenon is called field emission, and the field emission type electron-emitting source is an electron-emitting source utilizing the field emission phenomenon. To observe the field emission, a high electric field of $10^9$ V/cm must be applied to the solid surface. As a method of implementing field emission, an electric field is applied to a conductor with a sharp tip. According to this method, the electric field is concentrated to the sharp tip of the conductor, so that a required high electric field can be obtained to emit electrons from the tip of the conductor.

In this embodiment, a high electric field acts on the nanotube fibers of the coating film 132 constituting the field emission type electron-emitting source 130, so that electrons are field-emitted from the nanotube fibers. The field emission type electron-emitting source 130 has the plurality of through holes 131*a*, is arranged between the control electrodes 120 and electron extracting electrodes 140, and is connected to ground (GND). At this time, 0 V is applied to the control electrodes 120, and a positive voltage of, e.g., 2 kV is applied to the electron extracting electrodes 140, thereby making a high electric field act on the nanotube fibers. This can field-emit electrons from the nanotube fibers, and an emission current can be obtained.

Figure 4:
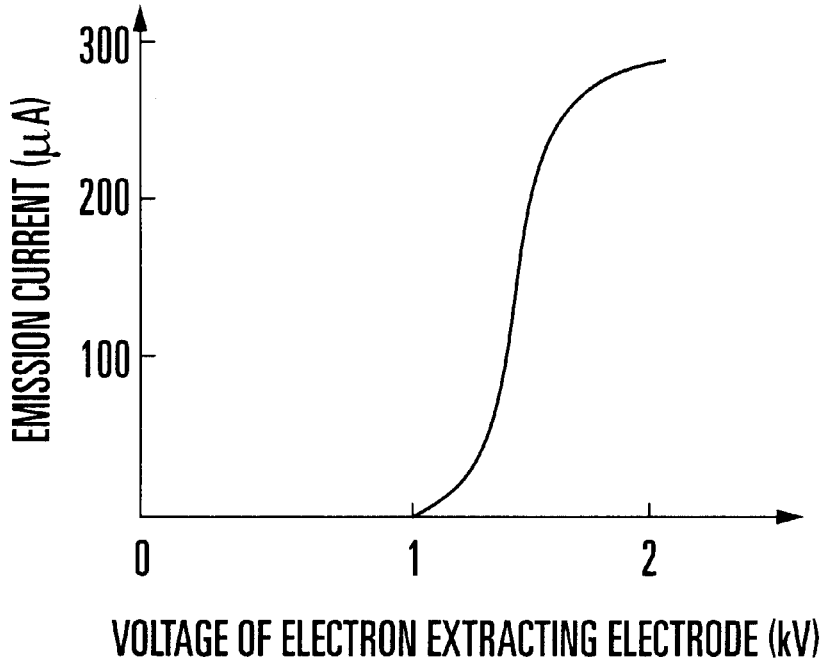
FIG. 4 is a graph showing the relationship between a voltage applied to an electron extracting electrode and an emission current generated by electrons emitted from the field emission type electron-emitting source.

FIG. 4 shows the relationship between a voltage applied to the electron extracting electrode 140 and an emission current generated by electrons emitted from the field emission type electron-emitting source 130. As shown in FIG. 4, to generate field emission from the field emission type electron-emitting source 130, a voltage equal to or higher than a predetermined threshold voltage must be applied to the electron extracting electrode 140 to set the strength of an electric field acting on the nanotube fibers to a predetermined threshold value or more. For example, if a voltage applied to the electron extracting electrode 140 is 1 kV or more, an emission current can be obtained.

On the other hand, if a negative voltage of, e.g., −1 kV is applied to the control electrode 120, the strength of the electric field acting on the nanotube fibers becomes lower than the predetermined threshold value because a negative electric field acts through the through holes 131*a* of the field emission type electron-emitting source 130. As a result, field emission is interfered, so an emission current cannot be obtained.

If, therefore, a positive voltage of, e.g., 2 kV is applied to the electron extracting electrodes 140, electrons are emitted from the first region of the field emission type electron-emitting source 130, i.e., a region sandwiched by the electron extracting electrode 140 and the corresponding control electrode 120 to which a voltage of 0 V is applied. Most of the emitted electrons pass through the mesh structure of the electron extracting electrode 140 and are accelerated toward the metal back film 112. The accelerated electrons are transmitted through the metal back film 112 and bombard against the phosphor film 111, causing it to emit light. Thus, the light-emitting portion 110 corresponding to the first region becomes the ON state 110*b*.

On the other hand, in the second region of the field emission type electron-emitting source 130, i.e., a region sandwiched by the electron extracting electrode 140 and the control electrode 120 to which a negative voltage of, e.g., −1 kV is applied, electron emission is inhibited. Accordingly, the light-emitting portion 110 corresponding to the second region becomes the OFF state 110*a*.

According to this embodiment, since the electron-emitting source is formed of a single plate-like member, operation check can be performed to only the electron-emitting source. This allows to find defective products before assembly, thus decreasing faults due to the electron-emitting source and increasing the manufacturing yield. Since the source is formed of a single member, assembly can be facilitated, and the number of assembling steps can be decreased. In addition, the electron-emitting source is comprised of the plate-like metal member with the through holes and serving as a growth nucleus for the nanotube fibers and the coating film formed of the nanotube fibers that cover the surface of the metal member and the walls of the through holes. Consequently, ON/OFF control by the control electrodes can be done, and uniform electron emission can be obtained at a high density.

Figure 5:
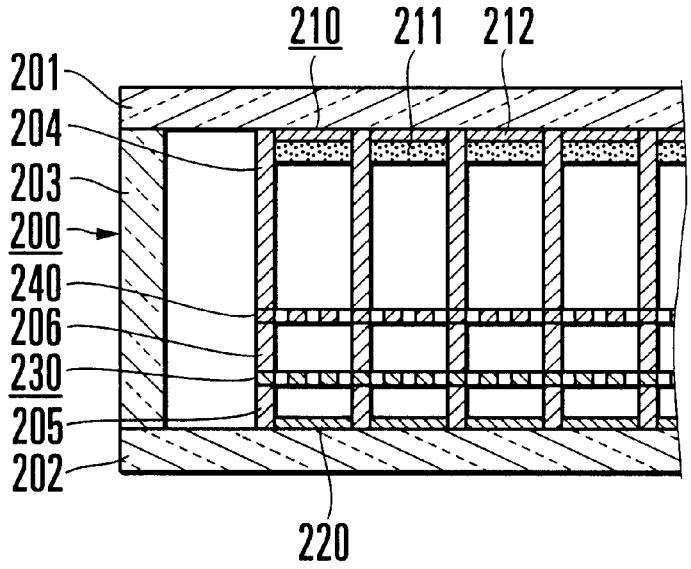
FIG. 5 is a sectional view showing the main part of a vacuum fluorescent display according to the second embodiment of the present invention.
Figure 6:
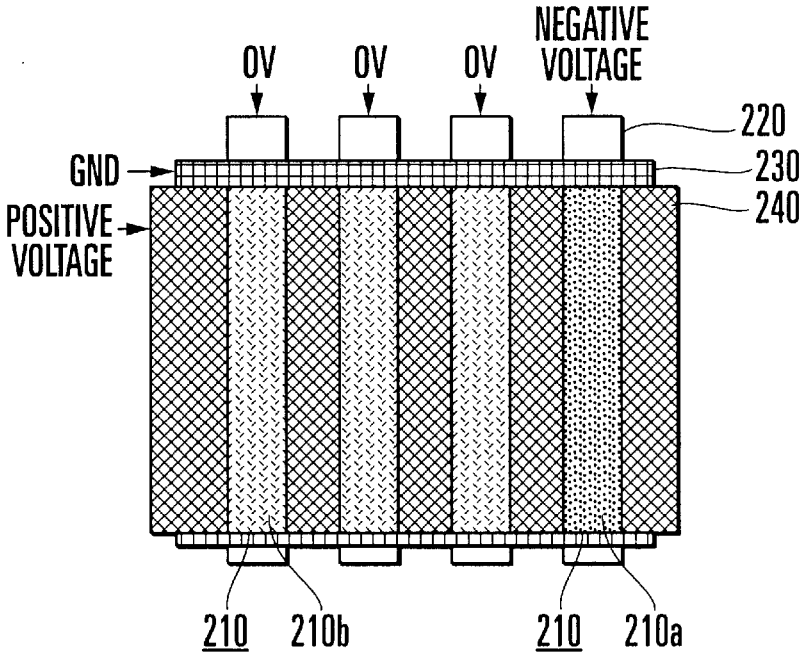
FIG. 6 is a view for explaining the relationship between voltages applied to electrodes and light emission states of light-emitting portions of the vacuum fluorescent display shown in FIG. 5.
Figure 7:
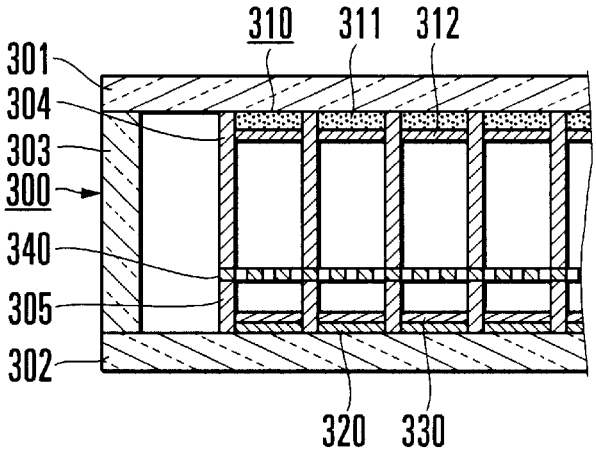
FIG. 7 PRIOR ART
FIG. 7 is a sectional view showing the main part of a conventional vacuum fluorescent display.
Figure 8:
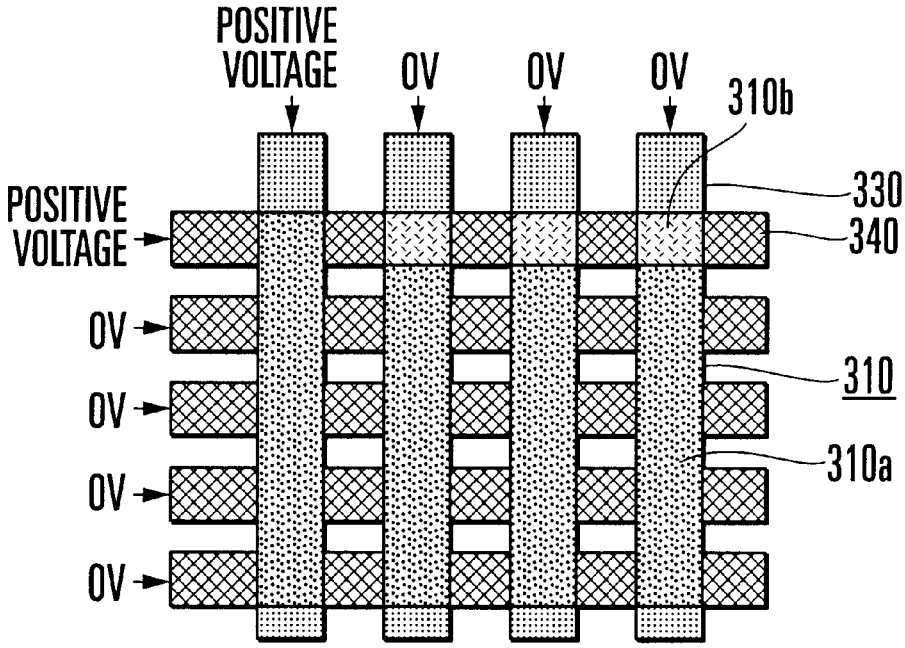
FIG. 8 PRIOR ART
FIG. 8 is a view for explaining the relationship between voltages applied to electrodes and light emission states of light-emitting portions of the conventional vacuum fluorescent display shown in FIG. 7.

The second embodiment of the present invention will be described below with reference to FIGS. 5 and 6.

This embodiment is different from the first embodiment in that each light-emitting portion 210 comprising of a display segment is constituted by a band-like transparent electrode 212 formed on the inner surface of a front grass member 201 and used as an anode, and a phosphor film 211 formed on the surface of the transparent electrode 212. In addition, an electron extracting electrode 240 is formed of a single plate-like member with a size almost equal to that of a field emission type electron-emitting source 230.

The front grass member 201, a substrate 202, and a spacer 203, all of which constitute an envelope 200, front support members 204, substrate support members 205, an intermediate support member 206, control electrodes 220, and the field emission type electron-emitting source 230 are the same as those in the first embodiment, and a description thereof will be omitted.

The transparent electrode 212 is formed of an ITO (Indium Tin Oxide) film as a transparent conductive film, and is formed on the inner surface of the front glass member 201 to have a predetermined pattern by using known sputtering and lift-off. The transparent electrode 212 is not limited to the ITO film, and another transparent conductive film such as an indium oxide film may be used. In place of a transparent conductive film, an aluminum thin film with an opening may be formed by using known sputtering and etching, to serve as the transparent electrode 212.

The phosphor film 211 is made of a phosphor that can be excited by a low-speed electron beam and with a predetermined light emission color. The phosphor film 211 is formed by screen-printing a phosphor paste on the transparent electrode 111 to have a predetermined display pattern, and calcining it. As the phosphor that can be excited by a low-speed electron beam, an oxide phosphor or sulfide phosphor generally used in a vacuum fluorescent display can be used. The types of phosphors may be changed for each display pattern so different light emission colors can be obtained, as a matter of course.

In the vacuum fluorescent display having the aforementioned arrangement, the field emission type electron-emitting source 230 is connected to ground (GND), and positive voltages (accelerating voltages) are applied to the electron extracting electrode 240 and the transparent electrodes 212 of the light-emitting portions 210. In this state, a voltage applied to each control electrode 220 switches the ON/OFF states of a corresponding one of the light-emitting portions 210 which opposes each control electrode 220. That is, when a voltage applied to the control electrode 220 is 0 V, the corresponding light-emitting portion 210 becomes an ON state 210*b*, and when a predetermined negative voltage is applied to the control electrode 220, the corresponding light-emitting portion 210 becomes an OFF state 210*a*.

According to this embodiment, since not only the field emission type electron-emitting source 230 but also the electron extracting electrode 240 is formed of a single plate-like member, assembly is further facilitated in addition to the effects in the first embodiment.

In this embodiment, the light-emitting portions 210 used as display segments are formed to have a band-like shape. The present invention is not limited to this, and the light-emitting portion 210 may be of any shape. Obviously, each control electrode 220 is formed such that its shape matches that of the light-emitting portion 210. In this case, the display patterns can be formed into the same shape as that of the thin-film transistors 210 and control electrodes 220 which are formed by printing, thus easily forming the display patterns even if they have a complicated shape.

As has been described above, according to the present invention, the field emission type electron-emitting source is not formed on the substrate directly. Since the electron-emitting source is formed independently of the substrate, operation check can be performed only the electron-emitting source. This can decrease substrate faults due to the electron-emitting source and increase the manufacturing yield. In addition, the electron-emitting source is formed of a single member, thereby reducing cost and facilitating assembly.

What is claimed is:

1. A vacuum fluorescent display comprising:

a front glass member which has light transmission properties at least partly;

a substrate opposing said front glass member through a vacuum space;

a control electrode formed on an inner surface of said substrate;

a plate-like field emission type electron-emitting source with a plurality of through holes which is arranged in the vacuum space to be spaced apart from said control electrode;

a mesh-like electron extracting electrode formed between said electron-emitting source and said front glass member to be spaced apart from said electron-emitting source; and a phosphor film formed inside said front glass member, wherein said electron-emitting source includes:

a plate-like metal member with a large number of through holes and serving as a growth nucleus for nanotube fibers; and a coating film made of a large number of nanotube fibers and formed on a surface of said metal member and inner walls of the through holes.

2. A display according to claim 1, wherein said phosphor film is formed into a shape corresponding to that of a pattern to be displayed, and said control electrode is formed into a shape corresponding to that of the pattern to be displayed and arranged to oppose said phosphor film.

3. A display according to claim 1, wherein said control electrode comprises a plurality of band-like control electrodes arranged parallel to each other, said electron extracting electrode comprises a plurality of band-like electron extracting electrodes formed to extend along a direction perpendicular to said bond-like control electrodes and arranged parallel to each other, and said phosphor film is arranged to oppose at least intersecting regions of said band-like control electrodes and said band-like electron extracting electrodes.

4. A display according to claim 1, wherein said control electrode comprises a plurality of band-like control electrodes arranged parallel to each other, said electron extracting electrode is formed of a single plate-like member with a size substantially equal to that of said electron-emitting source, and said phosphor film is arranged to oppose said band-like control electrodes.

5. A display according to claim 1, wherein said metal member is made of one of iron or iron-containing alloy, and said coating film is made of a large number of carbon nanotubes formed in a curled state.

6. A display according to claim 1, further comprising:

first support members formed on said substrate so as to divide said control electrode into a plurality of band-like electrodes and having upper portions on which said electron-emitting source is supported;

second support members formed on said electron-emitting source so as to correspond to said first support members and having upper portions on which said electron extracting electrode is supported; and third support members formed between said front glass member and said electron extracting electrode so as to correspond to said first and second support members.

7. A display according to claim 1, further comprising a light-emitting portion including said phosphor film formed on an inner surface of said front glass member and a metal back film formed on a surface of said phosphor film and used as an anode.

8. A display according to claim 1, further comprising a light-emitting portion including a transparent electrode formed on an inner surface of said front glass member and used as an anode and said phosphor film formed on a surface of said transparent electrode.

* * * * *